US010309636B2

(12) United States Patent
Sommerschuh

(10) Patent No.: US 10,309,636 B2
(45) Date of Patent: Jun. 4, 2019

(54) MOTOR VEHICLE HEADLIGHT LIGHTING MODULE WITH WAVELENGTH CONVERTER AND SEPARATE AIR DUCTS FOR COOLING

(71) Applicant: Valeo Vision, Bobigny (FR)

(72) Inventor: Stephan Sommerschuh, Paris (FR)

(73) Assignee: Valeo Vision (FR)

( * ) Notice: Subject to any disclaimer, the term of this patent is extended or adjusted under 35 U.S.C. 154(b) by 241 days.

(21) Appl. No.: 15/359,846

(22) Filed: Nov. 23, 2016

(65) Prior Publication Data

US 2017/0153002 A1 Jun. 1, 2017

(30) Foreign Application Priority Data

Nov. 27, 2015 (FR) ..... 15 61525

(51) Int. Cl.

| | |
|---|---|
| ***F21V 29/502*** | (2015.01) |
| ***F21V 29/67*** | (2015.01) |
| ***F21V 29/76*** | (2015.01) |
| ***F21V 29/83*** | (2015.01) |
| ***F21S 41/14*** | (2018.01) |
| ***F21S 41/25*** | (2018.01) |
| ***F21S 45/49*** | (2018.01) |
| ***F21S 45/43*** | (2018.01) |

(Continued)

(52) U.S. Cl.

CPC ..... *F21V 29/502* (2015.01); *F21S 41/14* (2018.01); *F21S 41/16* (2018.01); *F21S 41/25* (2018.01); *F21S 45/43* (2018.01); *F21S 45/49* (2018.01); *F21V 29/673* (2015.01); *F21V 29/763* (2015.01); *F21V 29/83* (2015.01); *F21S 41/19* (2018.01); *F21S 41/29* (2018.01); *F21Y 2115/30* (2016.08)

(58) Field of Classification Search

CPC ..... F21S 41/16; F21S 41/39; F21S 41/675; F21S 45/43; F21S 45/49; F21S 41/19; F21S 41/29; F21S 41/14; F21S 41/25; F21V 29/502; F21V 29/673; F21V 29/763; F21V 29/83; F21Y 2115/30

See application file for complete search history.

(56) References Cited

U.S. PATENT DOCUMENTS

| | | | |
|---|---|---|---|
| 8,118,462 | B2 | 2/2012 | Inoue et al. |
| 8,911,125 | B2 | 12/2014 | Suzuki et al. |

(Continued)

FOREIGN PATENT DOCUMENTS

| | | | |
|---|---|---|---|
| DE | 102010028949 | A1 | 11/2011 |
| EP | 2138759 | A1 | 12/2009 |

(Continued)

*Primary Examiner* — Anh T Mai
*Assistant Examiner* — Michael Chiang
(74) *Attorney, Agent, or Firm* — Oblon, McClelland, Maier & Neustadt, L.L.P.

(57) ABSTRACT

A motor vehicle headlight lighting module comprising at least one first light source, a device for converting the wavelength of the light emitted by the first light source; and a fan able to generate a flow of air.

The lighting module includes at least one first air duct and one second air duct that are separate, the fan being placed at the inlet of each of the first and second air ducts so as to distribute the flow of air between the ducts, the first light source and the wavelength converter device being disposed at the outlet of the first and second air ducts, respectively.

18 Claims, 2 Drawing Sheets

(51) Int. Cl.

| | |
|---|---|
| ***F21S 41/16*** | (2018.01) |
| *F21Y 115/30* | (2016.01) |
| *F21S 41/19* | (2018.01) |
| *F21S 41/29* | (2018.01) |

(56) References Cited

U.S. PATENT DOCUMENTS

| | | | | |
|---|---|---|---|---|
| 2007/0091632 | A1* | 4/2007 | Glovatsky | B60Q 1/0052 362/547 |
| 2009/0316425 | A1 | 12/2009 | Inoue et al. | |
| 2011/0280033 | A1* | 11/2011 | Kishimoto | F21S 41/16 362/543 |
| 2012/0224384 | A1* | 9/2012 | Takahira | F21K 9/56 362/509 |
| 2013/0058114 | A1 | 3/2013 | Reiners | |
| 2013/0201706 | A1* | 8/2013 | Suzuki | F21V 29/677 362/487 |
| 2014/0029282 | A1* | 1/2014 | Ravier | F21S 41/14 362/510 |
| 2015/0124468 | A1 | 5/2015 | Reiners | |
| 2016/0186957 | A1* | 6/2016 | Lewerich | F21S 41/16 362/509 |
| 2016/0201892 | A1* | 7/2016 | Chen | F21V 29/673 362/249.02 |
| 2017/0088034 | A1* | 3/2017 | Nakazato | B60Q 1/0023 |
| 2018/0031196 | A1* | 2/2018 | Cripps | F21S 41/62 |

FOREIGN PATENT DOCUMENTS

| | | | |
|---|---|---|---|
| EP | 2623851 | A1 | 8/2013 |
| EP | 2690352 | A1 | 1/2014 |
| FR | 2946730 | A1 | 12/2010 |

* cited by examiner

MOTOR VEHICLE HEADLIGHT LIGHTING MODULE WITH WAVELENGTH CONVERTER AND SEPARATE AIR DUCTS FOR COOLING

CROSS-REFERENCE TO RELATED APPLICATIONS

This application claims priority to the French application 1561525, filed Nov. 27, 2015, which application is incorporated herein by reference and made a part hereof.

BACKGROUND OF THE INVENTION

1. Field of the Invention

The present invention concerns a motor vehicle headlight lighting module of the type comprising: at least one first light source; a device for converting the wavelength of the light emitted by the first light source; and a fan able to generate a flow of air.

2. Description of the Related Art

It is known to provide headlights at the front of a motor vehicle able to form light beams to provide various lighting functions, for example of "high beam" or "low beam" type.

So-called adaptive lighting devices make it possible to adjust the beam intensity, dimensions and/or direction according to traffic conditions in order to provide these various functions.

Each headlight generally includes a plurality of lighting modules that make it possible to form a light beam of the headlight. The modules may be turned on and off independently of one another to vary the characteristics of the beam in real time.

By lighting module is meant a system containing at least one light source and a projection or reflection optical system.

Lighting modules as described in the document EP2690352, which is the equivalent of U.S. 2014/0029282, in the name of the Applicant notably comprise lighting devices including laser diode type light sources emitting blue light and a device able to convert the laser radiation into a beam of white light. A converter device of this kind consists of luminophore elements, for example.

The light sources and the converter device generate a considerable amount of heat when operating, and it is necessary to cool them. It is notably known to equip the lighting modules with fans that generate a flow of air able to cool the heating elements by convection.

The presence of a fan for each of the aforementioned elements makes optimum cooling possible. This solution is costly, however.

SUMMARY OF THE INVENTION

An object of the present invention is to propose an improvement to existing lighting modules notably optimizing the efficacy of the cooling of the various elements emitting heat.

To this end, the present invention relates to a lighting module of the aforementioned type including at least one first air duct and one second air duct that are separate, the fan being placed at the inlet of each of the first and second air ducts so as to distribute the flow of air between the ducts, the first light source and the wavelength converter device being disposed at the outlet of the first and second air ducts, respectively.

According to other advantageous aspects of the invention, the lighting module includes one or more of the following features, separately or in any technically possible combination:

the lighting module includes at least one second light source, the converter device being able to receive the light emitted by the second light source, the lighting module including at least one third air duct separate from the first and second air ducts, the fan being placed at the inlet of the third air duct so as to distribute the flow of air between the ducts, the second light source being disposed at the outlet of the third air duct;

the lighting module includes a support to which the fan, the wavelength converter device, the first light source and where applicable the second light source are fixed, the support comprising one or more internal walls defining the air ducts;

the air ducts are configured so as to direct onto the wavelength converter device a fraction between 10% and 40% inclusive, preferably between 15% and 25% inclusive, of the flow of air generated by the fan;

at least the first light source is in contact with a heatsink able to exchange heat with a flow of air, the heatsink being disposed in the air duct corresponding to the light source;

at least the first light source is a semiconductor light source, preferably a laser diode, emitting radiation the wavelength of which is preferably between 400 nm and 500 nm inclusive;

the wavelength converter device includes a plate able to reflect the laser radiation and a layer of luminophore covering the plate;

the lighting module further includes at least one reflector device able to deflect the light emitted by at least the first light source and to redirect the light onto the wavelength converter device; and the lighting module further includes an imaging optical system able to project the light re-emitted by the wavelength converter device.

The invention further relates to a motor vehicle headlight including at least one lighting module as described above.

These and other objects and advantages of the invention will be apparent from the following description, the accompanying drawings and the appended claims.

BRIEF DESCRIPTION OF THE ACCOMPANYING DRAWINGS

The invention will be better understood on reading the following description, given by way of nonlimiting example only and with reference to the drawings, in which.

DETAILED DESCRIPTION OF THE PREFERRED EMBODIMENTS

Figure 1:
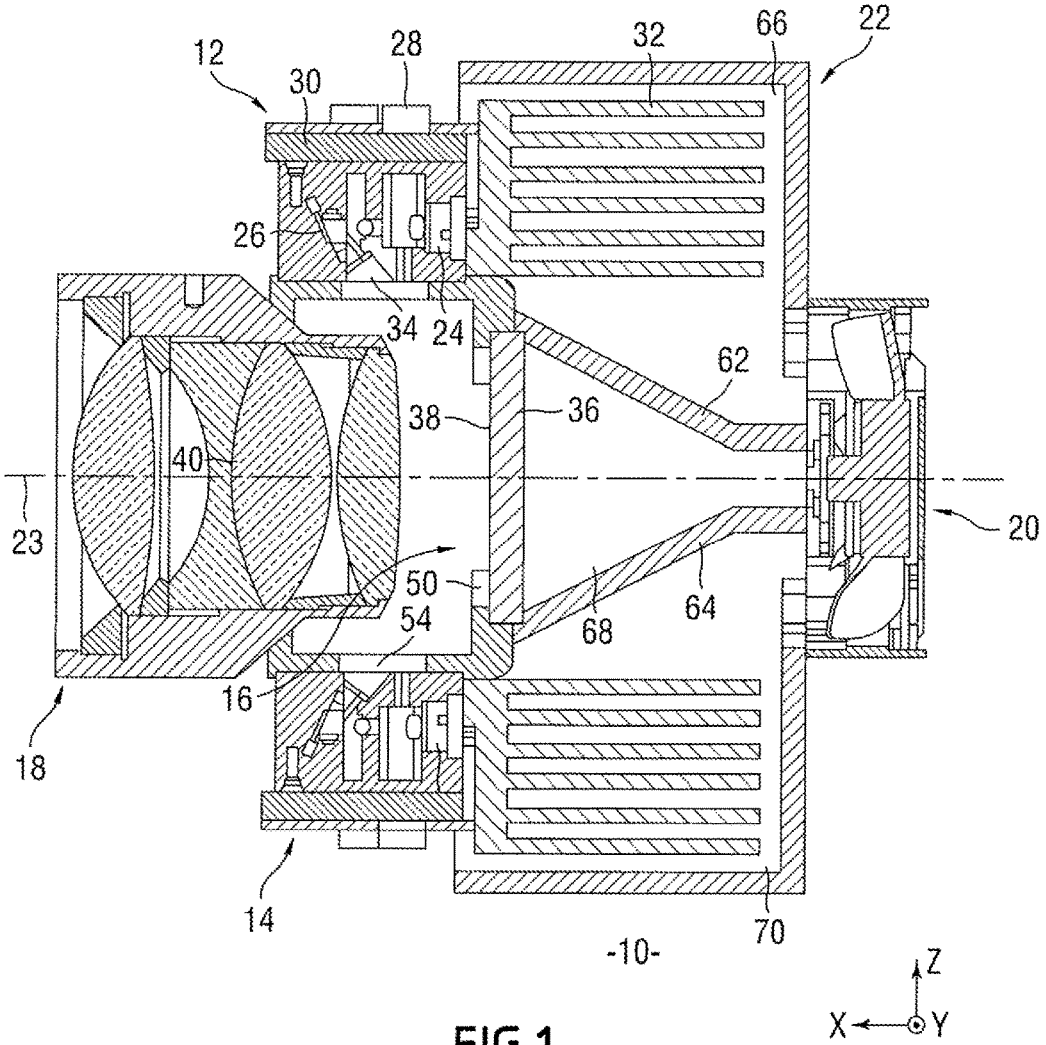
FIG. 1 is a view in section of a lighting module according to one embodiment of the invention.

FIG. 1 represents in section a lighting module 10 according to a first embodiment of the invention.

The lighting module 10 is intended to be incorporated into a motor vehicle headlight, the headlight possibly including one or more other lighting modules.

The lighting module 10 includes a first lighting device 12 and a second lighting device 14, a wavelength converter device 16 and an imaging optical system 18.

The lighting module 10 further includes a fan 20 able to generate a flow of air.

The lighting module 10 further includes a support 22 to which the first lighting device 12 and the second lighting device 14, the wavelength converter device 16, the imaging optical system 18 and the fan 20 are fixed.

Figure 2:
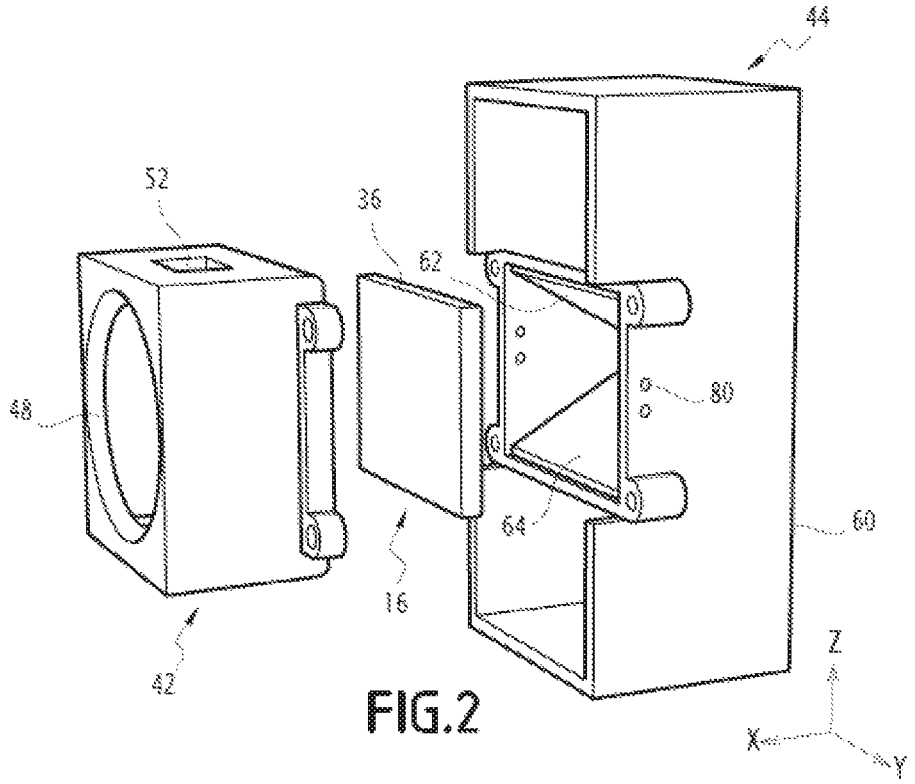
FIG. 2 is an exploded perspective view of components of the lighting module from FIG. 1.
Figure 3:
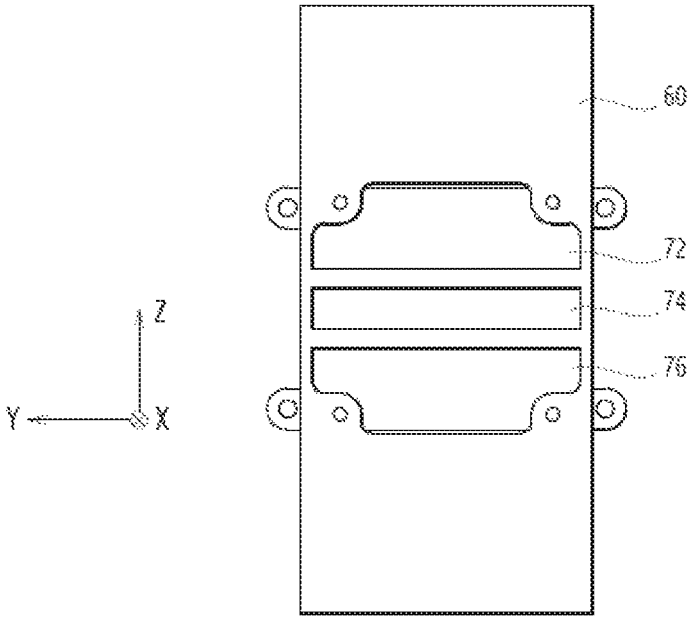
FIG. 3 is a back view of a component of the lighting module from FIG. 1.

An orthonomic frame of reference (X, Y, Z) represented in FIGS. 1, 2 and 3 is considered. The horizontal axes X and Y are respectively parallel and perpendicular to an optical axis 23 of the imaging optical system 18; the axis Z is vertical.

In the example from FIG. 1, the first lighting device 12 and the second lighting device 14 are substantially identical and correspond to the same description given hereinafter.

The first lighting device 12 and the second lighting device 14 include a light source 24 disposed on an emission axis substantially parallel to X. The light source 24 is preferably a semiconductor light source, more preferably a laser diode. In the example from FIG. 1, the light source 24 of the first lighting device 12 and the second lighting device 14 is a laser diode.

The light source or laser diode 24 emits for example a visible beam the wavelength of which is between 400 nm and 500 nm inclusive, preferably between 440 nm and 470 nm inclusive.

The first lighting device 12 and the second lighting device 14 further include an optical device able to concentrate the beam emitted by the laser diode 24.

The first lighting device 12 and the second lighting device 14 further include a reflector 26 able to direct towards the wavelength converter device 16 a light ray emitted by the laser diode 24 and concentrated by the optical device. The reflector 26 is preferably mobile in one or two directions so as to form a scanning system. In the example from FIG. 1, the reflector 26 is formed of a plurality of mirrors that are mobile independently. The movement of the mirrors of the reflector is notably controlled by an electronic circuit card 28.

The first lighting device 12 and the second lighting device 14 further include: an enclosure 30 enclosing the laser diode 24, the optical device and the reflector 26, and a heat exchanger or heatsink 32 assembled to the laser diode 24. The heat exchanger 32 is preferably a finned heatsink made from a material of good thermal conductivity such as aluminum.

The enclosure 30 includes a lateral orifice 34 allowing the light ray emitted by the laser diode 24 and deflected by the reflector 26 to exit towards the wavelength converter device 16.

The wavelength converter device 16 is for example formed of a substrate in the form of a plate 36 able to reflect the laser radiation onto which is deposited a continuous layer 38 of luminophore. The plate 36 is for example made of aluminum.

The continuous layer 38 of luminophore is disposed in a plane (Y, Z). The first lighting device 12 and the second lighting device 14 are respectively disposed above and below the continuous layer 38 along Z.

The plane (Y, Z) of the continuous layer 38 is close to a focal plane of the imaging optical system 18. The imaging optical system 18 includes for example one or more lenses 40.

In the example from FIG. 1, the support 22 of the lighting module 10 includes two separate components, to be more precise a lens assembly 42 and a casing 44. The lens assembly 42, the casing 44 and the wavelength converter device 16 are represented in an exploded perspective view in FIG. 2. The casing 44 is represented from behind in FIG. 3.

The lens assembly 42 and the casing 44 are assembled to each other, for example screwed together. The plate 36 of the wavelength converter device 16 is held between the lens assembly 42 and the casing 44 along the axis 23, the continuous layer 38 of luminophore being oriented towards the lens assembly 42.

The lens assembly 42 has a substantially parallelepiped shape with respective walls disposed in planes (X, Y), (X, Z) and (Y, Z).

The lens assembly 42 notably includes a front opening 48 and a rear opening 50 in respective walls disposed in the plane (Y, Z). The lens assembly 42 is assembled to the imaging optical system 18 at the level of the front opening 48. The lens assembly 42 is further assembled to the plate 36 of the wavelength converter device 16 at the level of the rear opening 50.

The lens assembly 42 also includes a top opening 52 and a bottom opening 54 in respective walls in the plane (X, Y). The lens assembly 42 is assembled to the first lighting device 12 and the second lighting device 14 at the level of the top opening 52 and the bottom opening 54, respectively. The top opening 52 and the bottom opening 54 each face the lateral orifice 34 of the enclosure 30 of the first lighting device 12 and the second lighting device 14.

The casing 44 also has a substantially parallelepiped shape. The casing 44 notably includes a back 60, disposed in the plane (Y, Z), and lateral external walls in the plane (X, Y) and (X, Z), respectively.

Moreover, the casing 44 includes two internal walls 62, 64 disposed on respective opposite sides of a plane of symmetry (X, Y) of the casing, the plane of symmetry passing through the optical axis 23. The internal walls 62, 64 bear on the lateral external walls in the plane (X, Z) of the casing 44.

The internal walls 62, 64 divide the interior of the casing 44 into three separate ducts 66, 68 and 70 isolated from one another and contiguous along Z. In particular, the casing 44 includes a central duct 68 and two lateral ducts 66 and 70.

The back 60 of the casing 44 includes three openings 72, 74 and 76 contiguous along Z. Each of the openings forms an inlet of a respective one of the ducts 66, 68 and 70. The fan 20 is assembled to the back 60 so as to cover the openings 72, 74 and 76. A flow of air generated by the fan 20 is therefore divided between the three separate ducts 66, 68 and 70.

The heatsink 32 of each of the first lighting device 12 and the second lighting device 14 is disposed inside the casing 44 in one of the two lateral ducts 66 and 70. A flow of air passing through each lateral duct 66, 70 is therefore able to cool a laser diode 24 via the corresponding heatsink 32.

The plate 36 of the wavelength converter device 16 is disposed at the outlet of the central duct 68 in contact with the edges of the internal walls 62, 64 and opposite the opening 74. The casing 44 preferably includes holes 80 in the vicinity of the plate 36 to form an air outlet of the central duct 68.

A flow of air passing through the central duct 68 is therefore able to cool the plate 36.

The position of the internal walls 62, 64 is configured so as to direct onto the plate 36 of the wavelength converter device 16 a fraction between 10% and 40% inclusive, preferably between 15% and 25% inclusive, of the flow of air generated by the fan 20. Each heatsink 32 therefore receives between 30% and 45% inclusive of the flow of air.

A method of operating the lighting module 10 will now be described. When each of the laser diodes 24 is fed with electricity, it emits laser radiation that is directed towards the wavelength converter device 16 by the reflector 26 that forms a scanning system. A number of points of the continuous layer 38 of luminophore therefore receive the laser radiation from the laser diode 24 successively.

In known manner, each point of the continuous layer 38 receiving the monochromatic and coherent "blue" laser radiation re-emits light considered "white", i.e. including a plurality of wavelengths between approximately 400 nm and approximately 800 nm inclusive.

The imaging optical system 18 then forms an image at infinity of the light spots of the continuous layer 38 of luminophore in the form of a light beam able to illuminate the road in front of a vehicle.

The wavelength conversion process heats the plate 36 of the wavelength converter device 16. Moreover, the heat diffused by each laser diode 24 is dissipated in the corresponding heatsink 32.

The fan 20 generates a flow of air divided into three separate flows, one in each of the ducts 66, 68 and 70. Each of the flows of air cools the plate 36 or one of the heatsinks 32, preventing overheating of the lighting module 10.

The shape of the casing 44 enables the formation in parallel of three separate flows of air from a single fan 20. It is therefore possible to modulate the quantity of air directed onto each of the components of the lighting module 10 liable to become heated in operation.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

The invention claimed is:

1. A motor vehicle headlight lighting module comprising:

at least one first light source;

a wave converter device for converting the wavelength of the light emitted by said at least one first light source; and a fan able to generate a flow of air;

a support to which said fan, said wavelength converter device and said at least one first light source is fixed, said support comprising one or more internal walls defining a first air duct and a second air duet separated from the first air duct by said one or more internal walls, wherein said fan is provided at an inlet of both of said first air duct and said second air duct so as to distribute a flow of air between said first air duct and said second air duct, and wherein said at least one first light source and said wavelength converter device are respectively disposed at an outlet of said first air duct and said second air duct.

2. The motor vehicle headlight lighting module according to claim 1, including at least one second light source, said wavelength converter device being able to receive the light emitted by said second light source, further comprising a third air duct separated from said first air duct and said second air duct by said one or more internal walls, said fan being provided at an inlet of said third air duct so as to distribute the flow of air between said first air duct, said second air duct and said third air duct, said second light source being disposed at an outlet of said third air duct.

3. The motor vehicle headlight lighting module according to claim 2, wherein said first air duct, said second air duct and said third air duct are configured so as to direct onto said wavelength converter device a fraction between 10% and 40% inclusive of the flow of air generated by said fan.

4. A motor vehicle headlight including at least one motor vehicle headlight lighting module according to claim 3.

5. The motor vehicle headlight lighting module according to claim 2, wherein said at least one first light source is in contact with a heatsink able to exchange heat with a flow of air, said heatsink being disposed in said air duct corresponding to said light source.

6. The motor vehicle headlight lighting module according to claim 2, wherein said at least one first light source is a semiconductor light source emitting radiation the wavelength of between 400 nm and 500 nm inclusive.

7. The motor vehicle headlight lighting module according to claim 2, wherein said wavelength converter device includes a plate able to reflect laser radiation and a layer of luminophore covering said plate.

8. The motor vehicle headlight lighting module according to claim 2, further comprising at least one reflector device able to deflect the light emitted by said at least one first light source and to redirect said light onto said wavelength converter device.

9. The motor vehicle headlight lighting module according to claim 2, further comprising an imaging optical system able to project the light re-emitted by said wavelength converter device.

10. A motor vehicle headlight including at least one motor vehicle headlight lighting module according to claim 2.

11. The motor vehicle headlight lighting module according to claim 2, wherein said first air duct, said second air duct and said third air duct are configured so as to direct onto said wavelength converter device a fraction between 15% and 25% inclusive of the flow of air generated by said fan.

12. The motor vehicle headlight lighting module according to claim 2, wherein said at least one first light source is a laser diode.

13. The motor vehicle headlight lighting module according to claim 1, wherein said at least one first light source is a semiconductor light source emitting radiation the wavelength of between 400 nm and 500 nm inclusive.

14. The motor vehicle headlight lighting module according to claim 1, wherein said wavelength converter device includes a plate able to reflect laser radiation and a layer of luminophore covering said plate.

15. The motor vehicle headlight lighting module according to claim 1, further comprising at least one reflector device able to deflect the light emitted by said at least one first light source and to redirect said light onto said wavelength converter device.

16. The motor vehicle headlight lighting module according to claim 1, further comprising an imaging optical system able to project the light re-emitted by said wavelength converter device.

17. A motor vehicle headlight including at least one motor vehicle headlight lighting module according to claim 1.

18. The motor vehicle headlight lighting module according to claim 1, wherein said at least one first light source is a laser diode.

* * * * *